US005365853A

United States Patent [19]

Petrovich et al.

[11] Patent Number: 5,365,853

[45] Date of Patent: Nov. 22, 1994

[54] HIGH VELOCITY PROJECTILE

[76] Inventors: Robert M. Petrovich, 10748 Bob White, P.O. Box 111, Hamburg, Mich. 48139; Paul A. Petrovich, 11269 Judd Rd., Fowlerville, Mich. 48836

[21] Appl. No.: 195,501

[22] Filed: Feb. 14, 1994

Related U.S. Application Data

[62] Division of Ser. No. 35,863, Mar. 23, 1993, abandoned.

[51] Int. Cl.[5] ..... F42B 12/34; F42B 14/04

[52] U.S. Cl. ..... 102/507; 102/511; 102/514

[58] Field of Search ..... 102/501, 502, 507–511, 102/514–518, 524–527, 529

[56] References Cited

U.S. PATENT DOCUMENTS

| | | | |
|---|---|---|---|
| 376,302 | 1/1888 | Gregg | 102/509 |
| 1,112,413 | 9/1914 | Hoagland | 102/507 |
| 4,108,074 | 8/1978 | Billing, Jr. et al. | 102/529 |
| 4,800,816 | 1/1989 | Meyer | 102/523 |
| 5,185,495 | 2/1993 | Petrovich et al. | 102/510 |

*Primary Examiner*—Harold J. Tudor

*Attorney, Agent, or Firm*—Peter A. Taucher; David L. Kuhn

[57] ABSTRACT

Disclosed is a projectile that has high velocity at short range. The projectile has a body of material that is lighter, more lubricous and more deformable than a partial Jacket on the rearward portion of the projectile. The jacket defines an annular array of apertures on the outer diametrical surface of the jacket and the body has peripheral zones that extend into the apertures far enough to be flush with the outer diametrical surface. The peripheral zones not only provide a physical lock between the body and jacket but also lubricate the interface between the projectile and the gun barrel along which the projectile travels during firing of a gun. The apertures are configured to allow the body to erupt radially outward through the jacket's side wall and form a relatively wide, shallow dispersal pattern when the projectile impacts a target. An optional core within the plastic body enhances the body's radially outward dispersal upon the projectile's impact with a target.

6 Claims, 2 Drawing Sheets

HIGH VELOCITY PROJECTILE

GOVERNMENT USE

The invention described herein may be manufactured, used and licensed by or for the U.S. Government for governmental purposes without payment to us of any royalty thereon.

This application is a divisional of application Ser. No. 08/035,863 filed Mar. 23, 1993 now abandoned.

BACKGROUND AND SUMMARY

The invention described herein relates to projectiles for guns and more particularly relates to projectiles for small rifled firearms. Our projectile is intended for use at short range, where the target is at a distance of one hundred feet or less.

Our projectile is comprised of a relatively light, soft body partly covered by a relatively hard, dense jacket. The jacket defines a belt-like array of apertures on the cylindrical outer surface of the Jacket and the body has peripheral zones that fit through the apertures far enough to be flush with the jacket's outer surface. The peripheral zones lock the body to the jacket and lubricate the interface between the projectile and a gun barrel in which the projectile travels. The apertures weaken the jacket along their belt-like array to allow the body to erupt radially outward through the jacket when the projectile hits a target.

An optional core within the body increases the body's radially outward dispersal when the projectile impacts a target. The core is disposed along a longitudinal axis of the projectile and is made of stronger material than the body. The core has a flat head in a forward region of the body and has a shank aft of the head, and there is a fluid filled chamber directly aft of the shank. When the body flattens upon the projectile's impact with a target, the head forces the flow of body material outward from the axis. Also upon impact, the shaft is driven into the fluid filled chamber and the fluid exerts radially outward force on the body to assist dispersal of the body.

DETAILED DESCRIPTION

Figure 1:
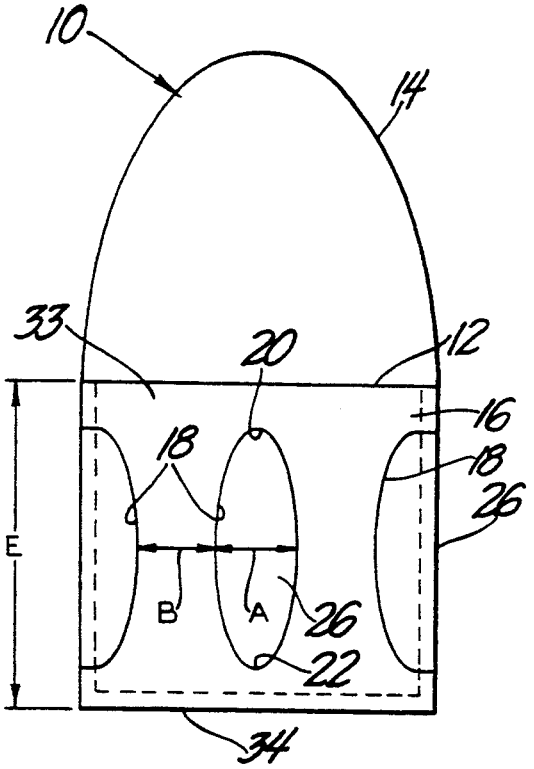
FIG. 1 is a side elevational view of a first embodiment of our improved high velocity projectile.
Figure 2:
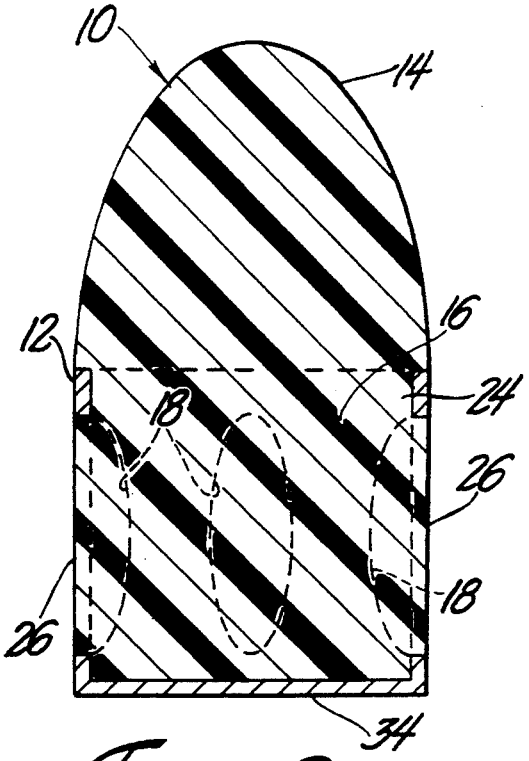
FIG. 2 is a longitudinal sectional view of the projectile shown in FIG. 1.

In FIG. 1 is shown a high velocity small arms projectile 10 whose jacket 12 partly covers a body made of plastic such as nylon or polytetraflouroethylene. The body can also be made of any other material that is less dense than and more easily deformable than the material of the jacket. The body is an integral unit comprised of a rounded frontal nose 14 and a posterior portion 16 adjacently behind the nose, the posterior portion being enclosed by jacket 12 behind nose 14. Jacket 12 is normally made of a soft metal such as mild steel, copper or brass, but can be made of any material which is equally or more malleable than these metals while being stronger and denser than the material of the body. Typically jacket 12 is a half jacket or three-quarters jacket covering a respective proportion of the plastic body and has an aft wall 34 completely covering the aft end of posterior portion 16. Aft wall 34 is normally integrally formed with the jacket but aft wall can also be a seperate element from the jacket, the aft wall being denser and stronger than the body. Jacket 12 defines a plurality of uniformly spaced apertures 18 and as seen in FIG. 2, posterior portion 16 fills apertures 18 so that its peripheral or outer surface areas 26 are flush with the outer surface of jacket 12. It can be seen that that posterior portion 16 physically locks with the jacket at apertures 18. Jacket 12 preferably defines four or five apertures 18 and these apertures are preferably elongated in along a fore-to-aft direction relative to the projectile as shown in FIGS. 1 and 2. It is also preferred that apertures 18 extend over the majority of the fore-to-aft dimension "E" of jacket 12 and that the fore end 20 and aft end 22 of the apertures be narrower than the aperture's minor diameter "A" midway between ends 20 and 22. It is also preferred that minor diameter "A" be at least as great as dimension "B" which is the minimum distance between apertures 18, and diameter "A" normally is larger than dimension "B". Apertures 18 are shown as ellipses in FIGS. 1 and 2, but apertures 18 may have other generally oval shapes or elongate diamond.

Figure 4:
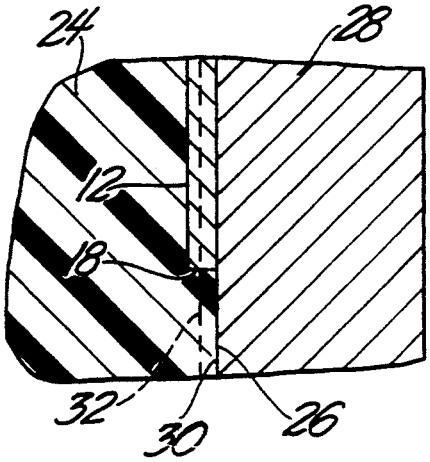
FIG. 4 shows a detail at an edge of a Jacket aperture in the first embodiment of the projectile. A portion of a rifled gun barrel engaging the projectile is also shown.

FIG. 4 is a detail view of zone 24 (FIG. 2) of projectile 10 when zone 24 bears against a section of the inner diameter of a rifled gun barrel 28. The figure shows a short longitudinal section of the barrel's rifling groove where numeral 30 denotes the bottom of the groove and the barrel's land is at 32. As is conventional, it is intended that the inner diameter of barrel 28, which is defined by lands 32, will be slightly smaller than the outer diameter of Jacket 12, whereby projectile is radially squeezed by the barrel. The radial squeezing tends to force surface area 26 radially outward from posterior portion 16 into bearing engagement with bottom 30 of the rifling groove and with land 32. Surface area 26 has greater lubricity than jacket 12 so that its bearing engagement with the groove and land eases the projectile's passage along the barrel and thereby increases projectile speed when the gun (not shown) is fired. As any given portion of surface area 26 rubs against the gun barrel, it leaves thereon a slight lubricating residue which eases passage of following, further aft portions of projectile 10. It is believed that the lubricating action will be most effective if surface area 26 is made of or is coated with nylon or polytetraflourethylene. The elongate shape of apertures 18 maximizes the size of the interface between the gun barrel and surface area 26 and consequently maximizes the lubricating effect of that surface area.

Since projectile 10 is comprised mainly of plastic or other relatively low density material, it will be lighter than metallic projectiles of similar volume and will have significantly greater speed than such metallic projectiles when exiting the barrel after the gun is fired. In most cases, projectile 10 will maintain its significant speed advantage for at least 100 feet, which is the intended range of the projectile. During initial penetration into a target, which is intended to be animal or human tissue, the plastic body of the projectile will flatten and radially expand. The radial expansion of the body will first break jacket 12 along a line around the Jacket connecting apertures 18 at or near their minor radii "A". Then, while penetration into the target is still shallow, the body will erupt radially outward, carrying shards of the cylindrical side wall 33 (FIG. 1) of jacket 12 with it. In general, the eruption will be will be broader and shallower as dimension "B" is smaller. Apertures 18 will cause the cylindrical side wall 33 of jacket 12 to break before the integrity of aft wall 34 is affected. Since aft wall 34 is denser than the plastic body, wall 34 will tend to axially compress the plastic body against the target after impact begins, and will contribute to the body's radially outward momentum.

Figure 3:
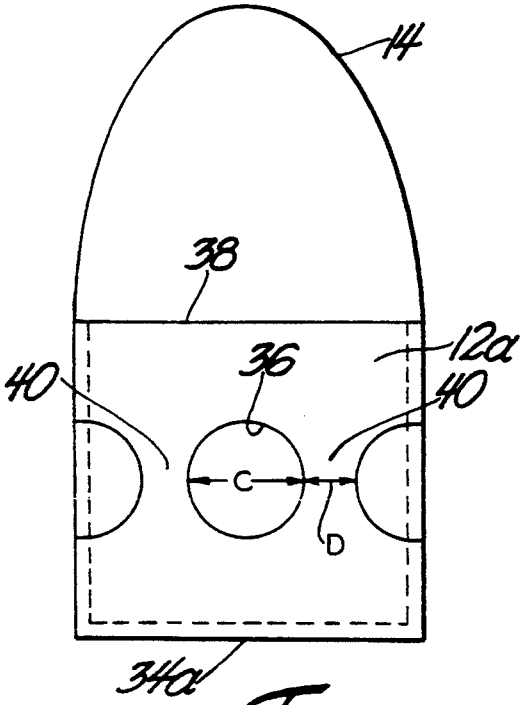
FIG. 3 is a side elevational view of an alternate embodiment of our projectile.

FIG. 3 shows an embodiment of our projectile that is in all respects the same as the FIG. 1 embodiment except that round apertures 36 in FIG. 2 replace elliptical apertures 18 in FIG. 1. Apertures 36 have a diameter "C" which preferably is two or more times as great as the distance "D" between the apertures. Apertures 36 are arranged in a circumferential array about jacket **12*a* and are typically disposed midway between forward edge 38 of the jacket and aft wall 34*a*. The distance "D" is preferably smaller either than the fore-to-aft distance between apertures 36 and forward edge 38 or the fore-to-aft distance between apertures 36 and aft wall 34*a*. "Distance D" is typically between one-third and two-thirds the size of either of these two fore-to-aft distances. The effect of keeping distance "D" smaller than diameter "C" and the aforementioned fore-to-aft distances is to insure that jacket 12*a* first breaks at necked zones 40 between apertures 36 when projectile 12*a*** expands radially upon initial impact with target.

Figure 5:
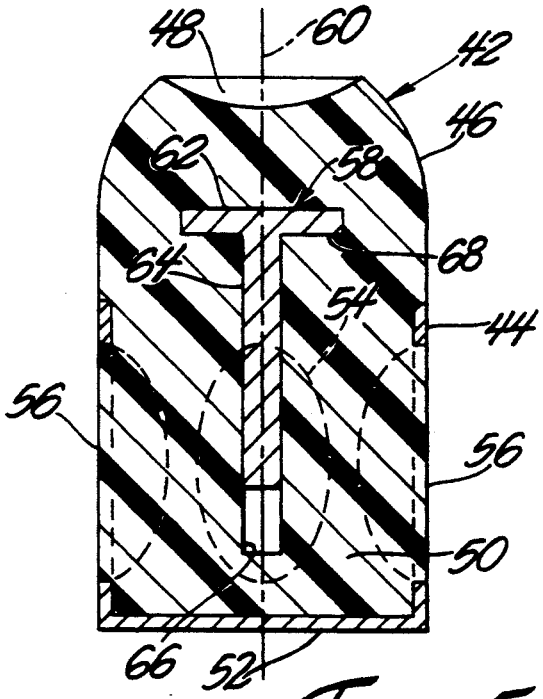
FIG. 5 is a cross sectional view of a second alternative embodiment of our projectile.

In FIG. 5 is shown another embodiment 42 of our high velocity small arms projectile having a jacket 44 in all respects similar to jacket 12 partly covering a body made of plastic such as nylon or polytetraflouroethylene. The fore end 46 of the body is disposed forward of jacket 44 and defines a dish shaped area or hollow point 48 at the nose of projectile 42. The plastic body has a posterior portion 50 integral with the fore end 46 and enclosed by jacket 44, the jacket having aft wall 52 completely covering the aft end of posterior portion 50. Jacket 44 defines a plurality of uniformly spaced oval apertures 54 that are similar to apertures 18 in FIG. 1. Posterior portion 50 fills apertures 54 such that outer surface areas 56 of portion 16 are flush with the outer surface of jacket 44 and so that posterior portion 50 physically locks with the jacket.

Projectile 42 has a core 58 embedded in the plastic body along central axis 60 of the projectile, the core being of stronger material than the plastic body. The forward end of core 58 has a disk shaped head 62 remote from hollow point 48 but still in fore end 46 of the body. Integrally attached to head 62 is an elongate shank 64 disposed along axis 60 behind disk 62, and a fluid filled chamber 66 is immediately behind the shank within posterior portion 50, the chamber being remote from wall 52. The fluid in chamber 66 can be a liquid such as an oil or a gas such as air.

Projectile 42 will function the same as projectile 10 during impact with a target except for the effect of core 58 on the plastic body. This effect of core 58 will vary, depending on the specific gravity or density of the core relative to the plastic body. If the core has a specific gravity less than the specific gravity of the plastic body, then upon the projectile's impact with a target, the plastic body will tend to move forward relative to the core. A central zone of the plastic body behind head 62 will be squeezed against rear head surface 68 as the plastic body flattens. The material of the central zone will be forced radially outward by the head, whereby radial spreading of the plastic body during target impact is enhanced. Also, since the core is moving forward relative to the core, chamber 66 is axially compressed, and the fluid therein will be forced radially outward. The fluid will in turn force the surrounding zone of the plastic body radially outward, thus further enhancing the radial spreading of the plastic body upon target impact.

If core 58 has a greater specific gravity than the plastic body, core 58 will tend at first to advance relative to the plastic body upon impact with the target so as to accelerate axial squeezing and radial spreading of the frontal portion of the plastic body between head 62 and hollow point 48. The rest of the body will impact the target a very short time later and create a secondary radially outward spreading of the projectile, the secondary spreading being similar to the target impact effect of the FIG. 1 embodiment of the projectile.

Figure 6:
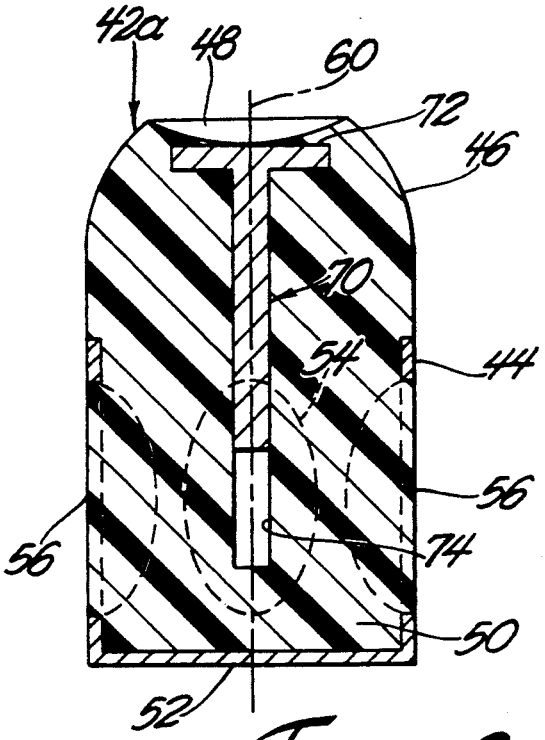
FIG. 6 is cross sectional view of a third alternative embodiment of our projectile.
Figure 7:
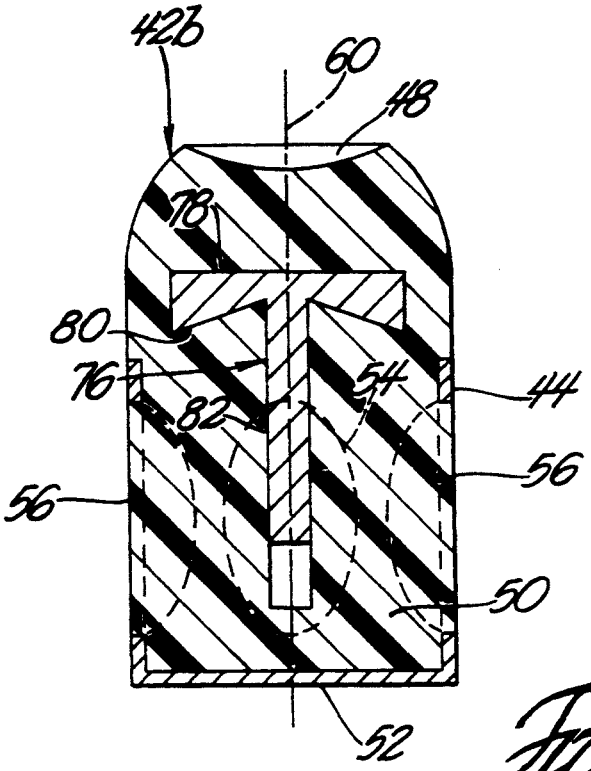
FIG. 7 is a cross sectional view of a fourth alternative embodiment of our projectile.

The FIG. 6 projectile **42*a* is the same as the FIG. 5 projectile, except that in FIG. 6, core 70 is moved further forward within the plastic body so that core head 72 is tangentially adjacent hollow point 48, and cheer 74 in FIG. 6 is longer than chamber 66 in FIG. 5. The FIG. 7 projectile 42*b* is the same as the FIG. 5 projectile except that in FIG. 7, core 76 has a rear surface 80 on head 78 which forms an acute angle with core stem 82**.

We wish it to be understood that we do not desire to be limited to the exact details of construction shown and described herein since obvious modifications will occur to those skilled in the relevant arts without departing from the spirit and scope of the following claims.

We claim:

1. A full caliber projectile suitable for firing from a rifled gun barrel, comprising:

a fore end;

an aft end;

a deformable body defining a nose of the projectile at the fore end and having a posterior portion at the aft end integral with the nose;

a jacket having a substantially uniform thickness, the jacket being of material denser and stronger than the body, the jacket adjacently surrounding only the posterior portion of the body;

the jacket defining a plurality of apertures therethrough adjacent a projectile exterior surface and disposed in an annular array about the jacket, the jacket sized diametrically in a vicinity of the apertures to engage rifling of the barrel, each aperture extending over a majority portion of a fore-to-aft dimension of the jacket;

dual purpose means for locking the body to the jacket and for reducing friction between the projectile and the barrel, the dual purpose means comprising peripheral portions of the posterior portion disposed in the apertures, the peripheral portions having greater lubricity than the jacket;

wherein the peripheral portions extend out from the body no further than an outer periphery of the jacket during a free state of the projectile.

2. The projectile of claim 1 wherein:

the apertures are elongate apertures having their major diameters oriented generally parallel to a longitudinal axis of the projectile, the major diameters being equal in length to a majority of a fore-to-aft dimension of the jacket;

the elongate apertures having minor diameters greater than circumferential distances between the elongate apertures;

so there is enhanced capability of deformable body to radially expand at the jacket during impact of the projectile with a target.

3. The projectile of claim 1 wherein the jacket includes an aft wall completely covering the aft end of the projectile, the aft wall being denser and stronger than the body.

4. The projectile of claim 1 wherein the peripheral portions are flush with an exterior surface of the jacket during the free state of the projectile.

5. The projectile of claim 1 wherein the body is made of plastic and the jacket is made of metal.

6. The projectile of claim 5 wherein the jacket has an aft wall completely covering the aft end of the projectile, the aft wall being denser and stronger than the body.

* * * * *